US010557093B2

(12) United States Patent
Patrick et al.

(10) Patent No.: US 10,557,093 B2
(45) Date of Patent: Feb. 11, 2020

(54) PROCESS FOR PRODUCING NAPHTHENIC BASE OILS

(71) Applicant: Ergon, Inc., Flowood, MS (US)

(72) Inventors: John K. Patrick, Brandon, MS (US); Howard Don Davis, Ridgeland, MS (US); Edward William Casserly, Madison, MS (US)

(73) Assignee: ERGON, INC., Flowood, MS (US)

( * ) Notice: Subject to any disclaimer, the term of this patent is extended or adjusted under 35 U.S.C. 154(b) by 0 days.

(21) Appl. No.: 16/135,132

(22) Filed: Sep. 19, 2018

(65) Prior Publication Data

US 2019/0016978 A1 Jan. 17, 2019

Related U.S. Application Data

(63) Continuation of application No. 15/511,442, filed as application No. PCT/US2015/050770 on Sep. 17, 2015, now Pat. No. 10,087,379.

(60) Provisional application No. 62/051,773, filed on Sep. 17, 2014.

(51) Int. Cl.

| | |
|---|---|
| ***C10G 65/12*** | (2006.01) |
| ***C10M 177/00*** | (2006.01) |
| ***C10M 101/02*** | (2006.01) |
| ***C10G 69/08*** | (2006.01) |

(52) U.S. Cl.

CPC ..... *C10G 69/08* (2013.01); *C10G 65/12* (2013.01); *C10M 101/02* (2013.01); *C10M 177/00* (2013.01); *C10G 2300/202* (2013.01); *C10G 2300/203* (2013.01); *C10G 2300/205* (2013.01); *C10G 2300/301* (2013.01); *C10G 2300/302* (2013.01); *C10G 2300/304* (2013.01); *C10M 2203/1065* (2013.01); (Continued)

(58) Field of Classification Search

CPC .. C10G 69/08; C10G 65/12; C10G 2300/205; C10G 2300/301; C10G 2300/202; C10G 2300/304; C10G 2300/203; C10G 2300/302; C10M 101/02; C10M 177/00; C10M 2203/1065; C10N 2220/031; C10N 2230/43; C10N 2220/022

See application file for complete search history.

(56) References Cited

U.S. PATENT DOCUMENTS

| | | | |
|---|---|---|---|
| 2,480,628 | A | 8/1949 | Bodkin |
| 3,663,430 | A | 5/1972 | Morris |
| 3,730,876 | A | 5/1973 | Sequeira, Jr. |

(Continued)

FOREIGN PATENT DOCUMENTS

| | | |
|---|---|---|
| EP | 0287234 | 10/1988 |
| EP | 1997868 A1 | 12/2008 |

OTHER PUBLICATIONS

Chinese First Office Action dated May 15, 2018, for Chinese Application No. 201580050079.1. English translation provided.

(Continued)

*Primary Examiner* — Randy Boyer
*Assistant Examiner* — Juan C Valencia
(74) *Attorney, Agent, or Firm* — Patterson Thuente Pedersen, P.A.

(57) ABSTRACT

A process for producing naphthenic base oils from low quality naphthenic crude feedstocks. The naphthenic base oils produced by the process have improved low temperature properties at high yields based on feedstock.

20 Claims, 1 Drawing Sheet

(52) U.S. Cl.
CPC .. *C10N 2220/022* (2013.01); *C10N 2220/031* (2013.01); *C10N 2230/43* (2013.01)

(56) References Cited

U.S. PATENT DOCUMENTS

| | | | | |
|---|---|---|---|---|
| 3,993,599 | A | 11/1976 | Mattox | |
| 4,100,056 | A | 7/1978 | Reynolds | |
| RE30,529 | E | 2/1981 | Reynolds | |
| 4,361,477 | A | 11/1982 | Miller | |
| 4,421,634 | A | 12/1983 | Olavesen | |
| 4,515,680 | A | 5/1985 | Hettinger, Jr. et al. | |
| 4,555,352 | A | 11/1985 | Garner et al. | |
| 4,657,661 | A | 4/1987 | Miller | |
| 4,699,707 | A | 10/1987 | Moorehead et al. | |
| 4,740,645 | A | 4/1988 | Garwood et al. | |
| 4,744,884 | A | 5/1988 | Morehead et al. | |
| 4,831,203 | A | 5/1989 | Owen et al. | |
| 4,851,602 | A | 7/1989 | Harandi et al. | |
| 4,942,021 | A | 7/1990 | Garwood et al. | |
| 4,966,680 | A | 10/1990 | Avidan et al. | |
| 5,011,902 | A | 4/1991 | Foucht | |
| 5,034,565 | A | 7/1991 | Harandi et al. | |
| 5,282,958 | A | 2/1994 | Santilli et al. | |
| 5,804,058 | A | 9/1998 | Grandvallet et al. | |
| 5,840,175 | A | 11/1998 | Aldous et al. | |
| 5,846,405 | A | 12/1998 | Aldous et al. | |
| 5,853,569 | A | 12/1998 | Aldous et al. | |
| 5,976,354 | A | 11/1999 | Powers et al. | |
| 6,024,864 | A | 2/2000 | Aldous et al. | |
| 6,080,302 | A | 7/2000 | Aldous et al. | |
| 6,294,077 | B1 | 9/2001 | Dougherty et al. | |
| 6,337,010 | B1 * | 1/2002 | Hofer | C10G 65/12 208/18 |
| 6,383,366 | B1 | 5/2002 | Riley et al. | |
| 6,576,120 | B1 | 6/2003 | Van Ballegoy et al. | |
| 7,179,365 | B2 | 2/2007 | Aldous et al. | |
| 7,261,808 | B2 | 8/2007 | Granvallet et al. | |
| 7,638,037 | B2 | 12/2009 | Benard et al. | |
| 7,776,206 | B2 | 8/2010 | Miller et al. | |
| 8,691,076 | B2 | 4/2014 | Kim et al. | |
| 8,911,613 | B2 | 12/2014 | Noh et al. | |
| 2005/0051463 | A1 * | 3/2005 | Miller | C10G 65/12 208/58 |
| 2005/0272850 | A1 | 12/2005 | Jois et al. | |
| 2007/0090016 | A1 | 4/2007 | Patrick et al. | |
| 2007/0175794 | A1 | 8/2007 | Duininck et al. | |
| 2009/0166252 | A1 | 7/2009 | Daage et al. | |
| 2013/0048537 | A1 | 2/2013 | Noh et al. | |
| 2017/0283718 | A1 | 10/2017 | Patrick et al. | |

OTHER PUBLICATIONS

Examination Report for corresponding EP Application No. 15771440.3 dated Jan. 16, 2018. 8 pages.

International Search Report for corresponding International Application No. PCT/US2015/050770 dated Nov. 25, 2015; 4 pages.

Written Opinion of the International Searching Authority for corresponding International Application No. PCT/US2015/050770 dated Nov. 25, 2015; 8 pages.

International Search Report for related International Application No. PCT/US2015/050782 dated Nov. 25, 2015; 4 pages.

Written Opinion of the International Searching Authority for related International Application No. PCT/US2015/050782 dated Nov. 25, 2015; 6 pages.

Süd-Chemie, "Hydex® Hydrodewaxing Catalysts," (2001); 20 pages.

Criterion Catalysts for Improved Lubricating Oil (2012); 2 pages. Retrieved online at http://www.criterioncatalysts.com/content/dam/shell/static/criterion/downloads/pdf/fact-sheets/lube-oil-factsheethires.pdf.

Application and File History for U.S. Appl. No. 15/511,442, filed Mar. 15, 2017, inventors Patrick et al.

* cited by examiner

PROCESS FOR PRODUCING NAPHTHENIC BASE OILS

CROSS-REFERENCE TO RELATED APPLICATION

This is a continuation application of U.S. application Ser. No. 15/511,442 filed Mar. 15, 2017, which claims benefit to National Phase entry of International Application No. PCT/US2015/050770 filed Sep. 17, 2015, which claims benefit to U.S. Provisional Application No. 62/051,773 filed Sep. 17, 2014, which are incorporated herein by reference in their entirety.

TECHNICAL FIELD

This invention relates to a process for the manufacture of naphthenic base oils.

BACKGROUND

Petroleum-derived base oils are mixtures of liquid hydrocarbons having desired physical properties (e.g., pour point, cloud point, viscosity, density, flash point or stability against oxidation) selected based on the desired end use application (e.g., lubricating oils, greases, transformer oils, refrigeration oils or process oils). Base oils may be used as is, blended with another oil or feedstock, or combined with one or more additives. Base oils typically are classified as either naphthenic or paraffinic. In general, naphthenic base oils are less widely used than paraffinic base oils, but are preferred for some industrial applications. However, the production of quality naphthenic base oils requires careful selection of processing steps in order to meet target performance characteristics and production costs.

SUMMARY OF THE INVENTION

Some naphthenic feedstocks contain undesirably high levels of wax molecules. Processing such feedstocks to remove such molecules may result in unacceptably low final product yields. Wax-free naphthenic crudes may instead be used, but even such crudes may contain sufficient amounts of normal paraffins or other wax-like high molecular weight components so as to cause visual haze in the finished product or higher than desired pour points or cloud points. These can represent undesirable characteristics for many end-use applications.

The present invention provides a process for producing naphthenic base oils having desirable properties such as low pour points, low cloud points, environmentally friendly characteristics and the ability to satisfy applicable specifications. The disclosed process can employ a variety of feedstocks including naphthenic crude oils, blends of naphthenic and paraffinic crude oils, or blends of naphthenic crude oils and other feedstocks while providing desirable final product properties and yields.

The present invention provides, in one aspect, a process for producing a naphthenic base oil comprising the steps of:

a) dewaxing a hydrotreated naphthenic effluent having a sulfur content of about 0.0005% to about 0.5% by weight (as measured by ASTM D4294) and a nitrogen content of up to about 0.1% by weight (as measured by ASTM D5762) in the presence of a dewaxing cracking catalyst and under catalytic dewaxing conditions to produce a dewaxed effluent;

b) hydrofinishing the dewaxed effluent to produce a dewaxed hydrofinished effluent having reduced levels of polycyclic aromatic hydrocarbons (PAH compounds, also known as polycyclic aromatics or PCA) and reduced levels of unstable olefinic compounds; and c) fractionating the dewaxed hydrofinished effluent to remove one or more low viscosity high volatility fractions and provide a naphthenic base oil having a pour point (as measured by ASTM D5949) below about −5° C., at a yield greater than 85% of total naphthenic base oil over total hydrotreated naphthenic effluent.

The present invention provides in another aspect a process for producing a naphthenic base oil comprising the steps of:

a) hydrotreating a naphthenic feedstock having a sulfur content of up to about 5% by weight (as measured by ASTM D4294) and a nitrogen content of up to about 3% by weight (as measured by ASTM D5762) in the presence of a hydrotreating catalyst and hydrotreating conditions to produce a hydrotreated naphthenic effluent having a sulfur content of about 0.0005% to about 0.5% by weight (as measured by ASTM D4294) and a nitrogen content of up to about 0.1% by weight (as measured by ASTM D5762);

b) dewaxing the hydrotreated naphthenic effluent in the presence of a dewaxing cracking catalyst and under catalytic dewaxing conditions to produce a dewaxed effluent;

c) hydrofinishing the dewaxed effluent to produce a dewaxed hydrofinished effluent having reduced levels of PAH compounds and reduced levels of unstable olefinic compounds; and d) fractionating the dewaxed hydrofinished effluent to remove one or more low viscosity high volatility fractions and provide a naphthenic base oil having a pour point (as measured by ASTM D5949) below about −5° C., at a yield greater than 85% of total naphthenic base oil over total naphthenic feedstock.

The disclosed process can expand the potential feedstock selection and improve desired qualities of the finished naphthenic base oil without unduly adversely affecting yields.

BRIEF DESCRIPTION OF THE DRAWING

Like reference symbols in the various FIGURES of the drawing indicate like elements.

DETAILED DESCRIPTION

Figure 1:
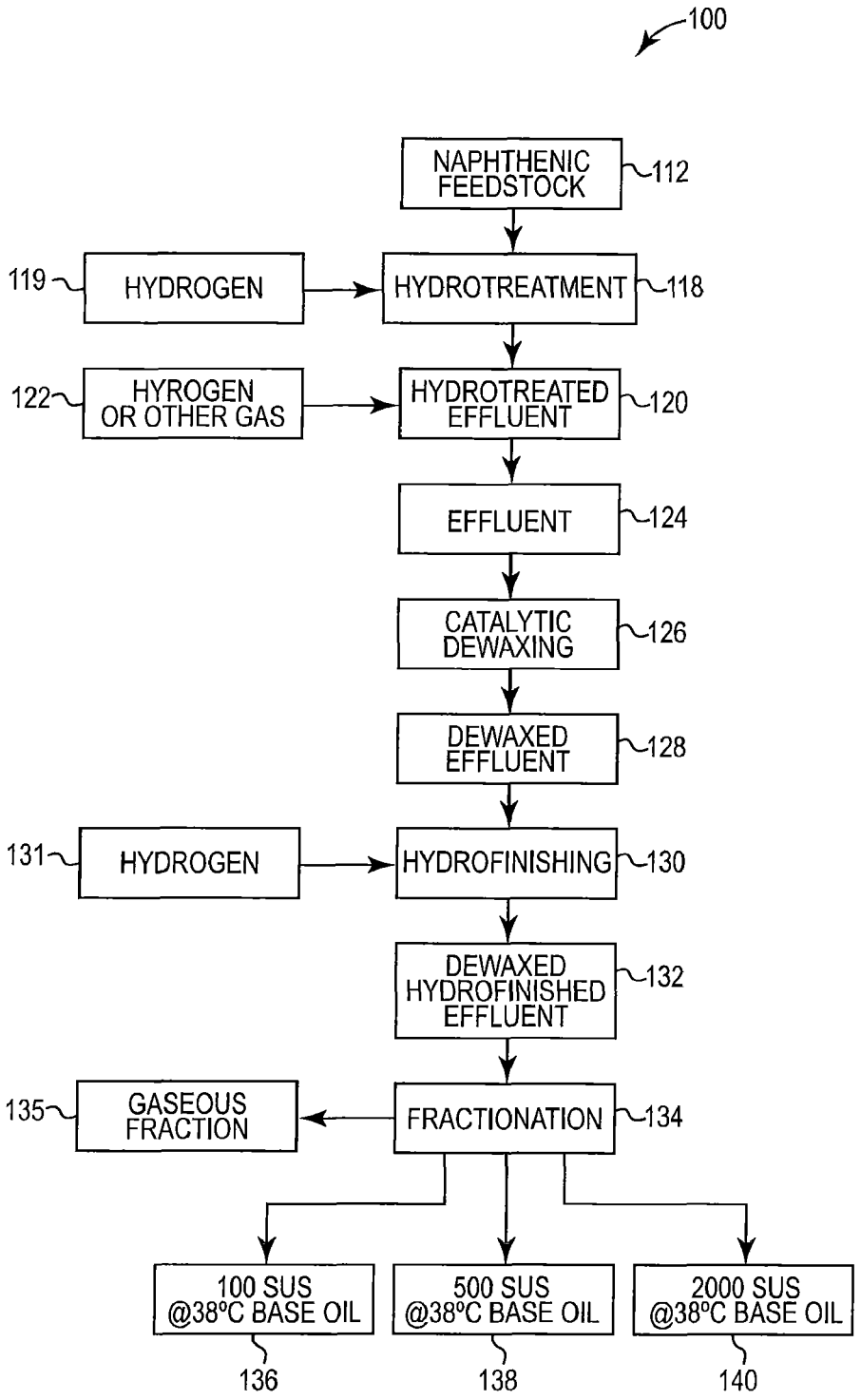
FIG. 1 is a schematic diagram illustrating one embodiment of the disclosed method.

Numerical ranges expressed using endpoints include all numbers subsumed within that range (e.g., 1 to 5 includes 1, 1.5, 2, 2.75, 3, 3.80, 4 and 5). All percentages are weight percentages unless otherwise stated.

The term "22-markers" when used with respect to a feedstock, process stream or product refers to the total quantity of the PAH compounds acenaphthene (ACE, CAS No. 83-32-9), acenaphthylene (ACY, CAS No. 208-96-8), anthracene (ANTH, CAS No. 120-12-7), benzo(a)anthracene (BaA, CAS No. 56-55-3), benzo(a)pyrene (BaP, CAS No. 50-32-8), benzo(b)fluoranthene (BbFA, CAS No. 205-99-a2), benzo(e)pyrene (BeP, CAS No. 192-97-2), benzo(ghi)perylene (BGI, CAS No. 191-24-2), benzo(j)fluoranthene (BjFA, CAS No. 205-82-3), benzo(k)fluoranthene (BkFA, CAS No. 207-08-9), chrysene (CHR, CAS No. 218-01-9), dibenzo(a,e)pyrene (DBaeP, CAS No. 192-65-4), dibenzo(a,h)anthracene (DBAhA, CAS No. 53-70-3), dibenzo(a,h)pyrene (DBahP, CAS No. 189-64-0), dibenzo(a,i)pyrene (DBaiP, CAS No. 189-55-9), dibenzo(a,l)pyrene (DBalP, CAS No. 191-30-0), fluoranthene (FLA, CAS No. 206-44-0), fluorene (FLU, CAS No. 86-73-7), indeno[123-cd]pyrene (IP, CAS No. 193-39-5), naphthalene (NAP, CAS No. 91-20-3), phenanthrene (PHN, CAS No. 85-01-8) and pyrene (PYR, CAS No. 129-00-0) in such feedstock, process stream or product. The term "18-markers" refers to a subset of the 22-markers PAH compounds, namely the PAH compounds acenaphthene, acenaphthylene, anthracene, benzo(a)anthracene, benzo(a)pyrene, benzo(b)fluoranthene, benzo(e)pyrene, benzo(ghi)perylene, benzo(j)fluoranthene, benzo(k)fluoranthene, chrysene, dibenzo(a,h)anthracene, fluoranthene, fluorene, indeno[123-cd]pyrene, naphthalene, phenanthrene and pyrene. The term "16-markers" refers to another subset of the 22-markers PAH compounds, namely the PAH compounds acenaphthene, acenaphthylene, anthracene, benzo(a)anthracene, benzo(a)pyrene, benzo(b)fluoranthene, benzo(ghi)perylene, benzo(k)fluoranthene, chrysene, dibenzo(a,h)anthracene, fluoranthene, fluorene, indeno[123-cd]pyrene, naphthalene, phenanthrene and pyrene. The term "8-markers" refers to yet another subset of the 22-markers PAH compounds, namely the compounds benzo(a)anthracene, benzo(a)pyrene, benzo(b)fluoranthene, benzo(e)pyrene, benzo(j)fluoranthene, benzo(k)fluoranthene, chrysene, and dibenzo(a,h)anthracene. Limits of 10 ppm for the sum of the 8-markers, and 1 ppm for benzo[a]pyrene are set forth in European Union Directive 2005/69/EC of the European Parliament and of the Council of 16 Nov. 2005. Industry and regulators have not yet set limits for 16-markers, 18-markers or 22-markers.

The term "aromatic" when used with respect to a feedstock, process stream or product refers to a liquid material having a viscosity-gravity constant (VGC) close to 1 (e.g., greater than about 0.95) as determined by ASTM D2501. Aromatic feedstocks or process streams typically will contain at least about 10% $C_A$ content and less than about 90% total $C_P$ plus $C_N$ content as measured according to ASTM D2140.

The term "ASTM" refers to the American Society for Testing and Materials which develops and publishes international and voluntary consensus standards. Exemplary ASTM test methods are set out below. However, persons having ordinary skill in the art will recognize that standards from other internationally recognized organizations will also be acceptable and may be used in place of or in addition to ASTM standards.

The term "hydrocracking" refers to a process in which a feedstock or process stream is reacted with hydrogen in the presence of a catalyst at very high temperatures and pressures, so as to crack and saturate the majority of the aromatic hydrocarbons present and eliminate all or nearly all sulfur-, nitrogen- and oxygen-containing compounds.

The term "hydrofinishing" refers to a process in which a feedstock or process stream is reacted with hydrogen in the presence of a catalyst under less severe conditions than for hydrotreating or hydrocracking, so as to reduce the levels of PAH compounds and stabilize (e.g., reduce the levels of) otherwise unstable molecules such as olefinic compounds. Hydrofinishing may for example be used following hydrocracking to improve the color stability and stability towards oxidation of a hydrocracked product.

The term "hydrogenated" when used with respect to a feedstock, process stream or product refers to a material that has been hydrofinished, hydrotreated, reacted with hydrogen in the presence of a catalyst or otherwise subjected to a treatment process that materially increases the bound hydrogen content of the feedstock, process stream or product.

The term "hydrotreating" refers to a process in which a feedstock or process stream is reacted with hydrogen in the presence of a catalyst under more severe conditions than for hydrofinishing and under less severe conditions than for hydrocracking, so as to reduce unsaturation (e.g., aromatics) and reduce the amounts of sulfur-, nitrogen- or oxygen-containing compounds.

The term "liquid yield" when used with respect to a process stream or product refers to the weight percent of liquid products collected based on the starting liquid material amount.

The term "lube yield" when used with respect to a distillation process stream or product refers to a value estimated from the distillation curve and representing the percent of liquid material boiling above a target volatility specification (for example, distillation temperature or flash point) for a specific market application.

The term "naphthenic" when used with respect to a feedstock, process stream or product refers to a liquid material having a VGC from about 0.85 to about 0.95 as determined by ASTM D2501. Naphthenic feedstocks typically will contain at least about 30% $C_N$ content and less than about 70% total $C_P$ plus $C_A$ content as measured according to ASTM D2140.

The terms "naphthenic base oil", "naphthenic lubricating oil" and "naphthenic lube oil" may be used interchangeably, and refer to an oil having a viscosity index between 10 and 80, for example greater than 10 and less than 70, as determined by ASTM D2270.

The term "paraffinic" when used with respect to a feedstock, process stream or product refers to a liquid material having a VGC near 0.8 (e.g., less than 0.85) as determined by ASTM D2501. Paraffinic feedstocks typically will contain at least about 60 wt. % $C_P$ content and less than about 40 wt. % total $C_N$+$C_A$ content as measured according to ASTM D2140.

The terms "Viscosity-Gravity Constant" or "VGC" refer to an index for the approximate characterization of the viscous fractions of petroleum. VGC is defined as the general relation between specific gravity and Saybolt Universal viscosity, and may be determined according to ASTM D2501. VGC is relatively insensitive to molecular weight.

The term "viscosity" when used with respect to a feedstock, process stream or product refers to the kinematic viscosity of a liquid. Kinematic viscosities typically are expressed in units of $mm^2/s$ or centistokes (cSt), and may be determined according to ASTM D445. Historically the petroleum industry has measured kinematic viscosities in units of Saybolt Universal Seconds (SUS). Viscosities at different temperatures may be calculated according to ASTM D341 and may be converted from cSt to SUS according to ASTM D2161.

The processing scheme for a naphthenic base oil stock may for example involve various processes and combinations of processes including vacuum distillation, hydrotreating, catalytic dewaxing, hydrofinishing and fractionation. Additional processing steps may optionally be employed before or after the steps mentioned above. Exemplary such steps include solvent extraction, solvent dewaxing and hydrocracking. In some embodiments no additional processing steps are employed, and in other embodiments additional processing steps such as any or all of solvent extraction, solvent dewaxing and hydrocracking are not required or are not employed.

Referring to FIG. 1, a method for producing naphthenic base oils is shown in schematic form. Steps 100 include subjecting a sulfur or nitrogen-containing naphthenic feedstock 112 to hydrotreatment 118 with a stream of hydrogen 119 to produce a hydrotreated effluent 120. Hydrotreated effluent 120 is contacted with a stream 122 of hydrogen or other gas at elevated temperatures for a sufficient time period to remove at least some of the sulfur or nitrogen compounds and produce effluent 124. Effluent 124 is catalytically dewaxed 126 to remove or convert waxes and wax-like compounds and produce dewaxed effluent 128. Effluent 128 is hydrofinished 130 with a stream of hydrogen 131 to stabilize any olefinic or unstable compounds that were created during the dewaxing step and produce dewaxed hydrofinished effluent 132. Effluent 132 is fractionated 134 to separate it into one or more gaseous fractions 135 and one or more liquid fractions. e.g., base oils having a variety of viscosity grades, for example about 52 to about 2800 Saybolt Universal Seconds (SUS) at 37.8° C., such as Naphthenic 100 SUS, 500 SUS and 2000 SUS base oils 136, 138 and 140.

The disclosed process can employ a variety of naphthenic feedstocks, including naphthenic crudes, waxy naphthenic crudes, naphthenic distillates (including lube, atmospheric and vacuum distillates), mixtures thereof, and blends of naphthenic crude, waxy naphthenic crude or a naphthenic distillate with amounts (e.g., lesser amounts) of other petroleum-based or synthetic materials including paraffinic feedstocks, paraffinic distillates (including lube, atmospheric and vacuum distillates), light or heavy cycle oil (coker gas oil), deasphalted oil (DAO), cracker residues, hydrocarbon feedstocks containing heteroatom species and aromatics and boiling at about 150° C. to about 550° C. (as measured by ASTM D7169), and mixtures thereof. The disclosed process is particularly suited for feedstocks made from or containing major portions (e.g., more than 50 wt. %) of naphthenic vacuum distillate fractions, and feedstocks containing appreciable portions (e.g., not more than 50 wt. %) of DAOs containing substantial amounts of sulfur- and nitrogen-containing compounds. The boiling range of such vacuum distillate fractions may for example be between about 300° and about 620° C. or between about 350° C. and about 580° C. Suitable DAO fractions include deasphalted atmospheric residues, deasphalted vacuum residues or both.

The chosen feedstock may contain sulfur levels up to about 5% by weight (viz, up to about 50,000 ppm) as determined by ASTM D4294, and nitrogen levels up to about 3% by weight (viz., up to about 30,000 ppm) as determined by ASTM D5762. Such nitrogen and sulfur levels allow retention or attainment of desirable properties in the finished product such as viscosity, aniline point, solvency and base oil yield.

The chosen feedstock (e.g. a vacuum distillate fraction or other sulfur or nitrogen-containing feedstock) is hydrotreated using techniques that will be familiar to persons having ordinary skill in the art. The primary purpose of hydrotreating is to remove sulfur, nitrogen and polar compounds and to saturate some aromatic compounds. The hydrotreating step thus produces a first stage effluent or hydrotreated effluent having at least a portion of the aromatics present in the feedstock converted to their saturated analogs, and the concentration of sulfur- or nitrogen-containing heteroatom compounds decreased. The hydrotreating step may be carried out by contacting the feedstock with a hydrotreating catalyst in the presence of hydrogen under suitable hydrotreating conditions, using any suitable reactor configuration. Exemplary reactor configurations include a fixed catalyst bed, fluidized catalyst bed, moving bed, slurry bed, counter current, and transfer flow catalyst bed.

The hydrotreating catalyst is used in the hydrotreating step to remove sulfur and nitrogen and typically includes a hydrogenation metal on a suitable catalyst support. The hydrogenation metal may include at least one metal selected from Group 6 and Groups 8-10 of the Periodic Table (based on the IUPAC Periodic Table format having Groups from 1 to 18). The metal will generally be present in the catalyst composition in the form of an oxide or sulfide. Exemplary metals include iron, cobalt, nickel, tungsten, molybdenum, chromium and platinum. Particularly desirable metals are cobalt, nickel, molybdenum and tungsten. The support may be a refractory metal oxide, for example, alumina, silica or silica-alumina. Exemplary commercially available hydrotreating catalysts include LH-23, DN-200, DN-3330, and DN-3620 from Criterion. Companies such as Albemarle, Axens, Haldor Topsoe, and Advanced Refining Technologies also market suitable catalysts.

The temperature in the hydrotreating step typically may be about 260° C. (500° F.) to about 399° C. (750° F.), about 287° C. (550° F.) to about 385° C. (725° F.), or about 307° C. (585° F.) to about 351° C. (665° F.). Exemplary hydrogen pressures that may be used in the hydrotreating stage typically may be about 5,515 kPa (800 psig) to about 27,579 kPa (4,000 psig), about 8,273 kPa (1,200 psig) to about 22,063 kPa (3,200 psig), or about 11,721 kPa (1700 psig) to about 20,684 kPa (3,000 psig). The quantity of hydrogen used to contact the feedstock may typically be about 17.8 to about 1,780 $m^3/m^3$ (about 100 to about 10,000 standard cubic feet per barrel (scf/B)) of the feedstock stream, about 53.4 to about 890.5 $m^3/m^3$ (about 300 to about 5,000 scf/B) or about 89.1 to about 623.4 $m^3/m^3$(500 to about 3,500 scf/B). Exemplary reaction times between the hydrotreating catalyst and the feedstock may be chosen so as to provide a liquid hourly space velocity (LHSV) of about 0.25 to about 5 cc of oil per cc of catalyst per hour ($hr^{-1}$), about 0.35 to about 1.5 $hr^{-1}$, or about 0.5 to about 0.75 $hr^{-1}$.

The reactor effluent may include sulfur- and nitrogen-containing gases (e.g., ammonia and hydrogen sulfide) produced in the hydrotreating step. The amounts of such gases may be reduced, for example to help protect the dewaxing cracking catalyst from becoming poisoned, improve the activity of or prolong the life of the dewaxing cracking catalyst, or to lessen the amount of dewaxing cracking catalyst required for the disclosed process. Reduced ammonia and hydrogen sulfide content may be achieved by contacting the hydrotreated effluent with a stream of hydrogen (or other gas) at elevated temperatures for a sufficient time period to remove at least some of the nitrogen or sulfur compounds. The gas stream preferably is predominantly hydrogen (e.g., greater than 50% by volume).

Hydrotreating may be followed by a catalytic dewaxing step. In this step, the dewaxing cracking catalyst reduces (e.g., by converting) the amount of waxes (e.g., hydrocarbons which solidify easily) or wax-like components present in the feedstock or the hydrotreated effluent. Such waxes and wax-like components, when present, are capable of adversely affecting cold-flow properties such as pour points and cloud points. Waxes may include high temperature melting paraffins, isoparaffins and monocyclic compounds such as naphthenic compounds having alkyl side chains.

The dewaxing cracking catalyst may be any catalyst suitable for cracking (viz., breaking down) large hydrocarbon molecules into smaller molecules in the presence of hydrogen and reducing the pour point of the hydrotreated effluent. Cracking catalysts may be distinguished from isomerization catalysts which primarily rearrange molecules rather than cracking large molecules into smaller molecules. Dewaxing catalysts that tolerate feedstock contaminants or catalyst poisons and have a high selectivity to cracking of waxy n-paraffins are preferred. For example, the dewaxing catalyst should tolerate hydrotreated effluents containing up to about to 0.5% by weight sulfur as determined by ASTM D4294(viz., up to about 5000 ppm) and up to about 0.1% by weight nitrogen as determined by ASTM D5762 (viz., up to about 1000 ppm). In some embodiments, the catalyst is tolerant to hydrotreated effluents containing about 0.01 to about 0.15 wt. % sulfur. In other embodiments, the catalyst is tolerant to hydrotreated effluents containing about 0.01 to about 0.1 wt. % nitrogen. Removal of higher levels of sulfur and nitrogen from the hydrotreated effluent may require more severe process conditions (e.g., hydrocracking at temperatures above 700° C.), resulting in reduced solvency of the finished product and lower yields. The disclosed process allows for retention of or improvement in desirable solvency characteristics of the naphthenic feedstock while reducing or minimizing yield loss.

Exemplary dewaxing cracking catalysts include heterogeneous catalysts having a molecular sieve and metallic functionality that provides hydrogenation catalyzation. Examples include medium pore molecular sieve zeolite catalysts having a 10-membered oxygen ring such as catalysts with a ZSM-5 designation. The metal used in the dewaxing catalyst desirably is a metal having hydrogenation activity selected from among Group 2, 6, 8, 9 and 10 metals of the periodic table. Preferred metals include Co and Ni among Group 9 and 10 metals, and Mo and W among Group 6 metals.

Exemplary other dewaxing cracking catalysts include synthetic and natural faujasites (e.g., zeolite X and zeolite Y), erionites, and mordenites. They may also be composited with purely synthetic zeolites such as those of the ZSM series. A combination of zeolites can also be composited in a porous inorganic matrix. Exemplary such catalysts include metal-impregnated dual functional mordenite framework inverted (MFI) type zeolite metal loaded catalysts. In some embodiments, the MFI type zeolite metal loaded catalyst desirably has a 1.5 mm (1/16") or 2.5 mm (1/10") particle size. Exemplary commercially available dewaxing cracking catalysts include those sold under the trademark HYDEX™ (e.g. HYDEX L, G and C) by Clariant as well as various zeolite catalysts sold by Albemarle (e.g. KF-1102).

The dewaxing cracking catalyst may be amorphous. Exemplary amorphous dewaxing cracking catalysts include alumina, fluorided alumina, silica-alumina, fluorided silica-alumina and silica-alumina doped with Group 3 metals. Such catalysts are described in, for example, U.S. Pat. Nos. 4,900,707 and 6,383,366, both of which are incorporated herein by reference.

Dewaxing conditions typically include temperatures of about 260° C. (500° F.) to about 399° C. (750° F.), about 287° C. (550° F.) to about 371° C. (700° F.), or about 301° C. (575° F.) to about 343° C. (650° F.), and pressures of about 5,515 kPa (800 psig) to about 27,579 kPa (4000 psig), about 5,515 kPa (800 psig) to about 22,063 kPa (3200 psig), or about 8,273 kPa (1200 psig) to about 20,684 kPa (3000 psig). The liquid hourly space velocities may range from about 0.25 to about 7 $hr^{-1}$, about 1 to about 5 $hr^{-1}$; or about 1.5 to about 2 $hr^{-1}$ and hydrogen treat gas rates may range from about 45 to about 1780 $m^3/m^3$ (250 to 10,000 scf/B), preferably about 89 to about 890 $m^3/m^3$ (500 to 5,000 scf/B).

The disclosed process has been found to be particularly suitable for the preparation of naphthenic base oils from a naphthenic feedstock containing between about 0.5 wt. % and 15 wt. %, or about 2 wt. % to about 10 wt. %, or about 1 wt. % to about 8 wt. % waxy compounds in the total feedstock. The dewaxed effluent desirably has a pour point reduced by at least 10° C. or by at least 20° C. compared to that of the naphthenic feedstock, for example a pour point below about −5° C., below about −10° C. or below about −15° C. The dewaxed effluent also desirably has a cloud point reduced by at least 10° C. compared to that of the naphthenic feedstock.

The disclosed process desirably includes dewaxing catalyst regeneration if the catalyst activity has been reduced, for example due to coking, sulfur poisoning, or nitrogen poisoning. Regeneration can for example be conducted in-situ using a hot hydrogen strip of the catalyst at a temperature ranging from about 357° C. (675° F.) to about 399° C. (750° F.) for a period of between 4 hrs and 12 hrs.

The product obtained in the catalytic dewaxing process is also subjected to a hydrofinishing step. The primary purpose of this step is to stabilize any olefinic or unstable compounds that were created during the dewaxing step, improving oxidation and color stability. Hydrofinishing may also advantageously decrease the remaining aromatic content, and in particular any PAH compounds left in the dewaxed effluent, so that the base oils thus obtained will be able to meet specific PAH standards. In addition to control of specific PAH compounds, the hydrofinishing step may also enable better control over aniline point, refractive index, aromatic/naphthenic ratio, or other direct or indirect measurements of solvency.

Exemplary hydrofinishing catalysts include catalysts like those discussed above in connection with hydrotreating, for example nickel, molybdenum, cobalt, tungsten, platinum and combinations thereof. The hydrofinishing catalyst may also be incorporated into a multi-functional (for example, bifunctional) dewaxing catalyst. A bifunctional dewaxing catalyst will have both a dewaxing function and a hydrogenation function. The hydrogenation function is preferably provided by at least one Group 6metal, at least one Group 8-10 metal, or mixtures thereof. Desirable metals include Group 9-10 metals (for example, Group 9-10 noble metals) such as Pt, Pd or mixtures thereof. These metals may for example be present in an amount of about 0.1 to 30 wt. %, about 0.1to about 10 wt. %, or about 0.1 to about 5 wt. %, based on the total weight of the catalyst. Catalyst preparation and metal loading methods are described for example in U.S. Pat. No. 6,294,077, which is incorporated herein by reference, and include, for example, ion exchange and impregnation using decomposable metal salts. Metal dispersion techniques and catalyst particle size control are described for example in U.S. Pat. No. 5,282,958, which is also incorporated herein by reference. Catalysts with small particle size and well-dispersed metals are preferred.

Hydrofinishing conditions normally involve operating temperatures of from about 260° C. (500° F.) to about 399° C. (750° F.), about 287° C. (550° F.) to about 371° C. (700° F.), or about 301° C. (575° F.) to about 329° C. (625° F.); and pressures from about 5,515 kPa (800 psig) to about 27,579 kPa (4000 psig), about 5,515 kPa (800 psig) to about 22,063 kPa (3,200 psig), or about 8,273 kPa (1200 psig) to about 20,684 kPa (3,000 psig). Liquid hourly space velocities may for example be about 0.25 to about 5 $hr^{-1}$, about 1 to about 4 $hr^{-1}$; or about 2 to about 2.5 $hr^{-1}$.

The dewaxing and hydrofinishing steps may if desired be carried out in separate reactors. Desirably the dewaxing and hydrofinishing steps take place sequentially in the same reaction vessel. Doing so may improve operations and reduce capital cost requirements.

The dewaxed hydrofinished effluent is fractionated to separate it into one or more gaseous fractions and one or more liquid fractions. Fractionation may be performed using methods that will be familiar to persons having ordinary skill in the art, such as distillation under atmospheric or reduced pressure. Distillation under reduced pressure (for example vacuum flashing and vacuum distillation) is preferred. The cutpoints of the distillate fractions preferably are selected such that each product distillate recovered has the desired properties for its envisaged application. For base oils, the initial boiling point will normally be for example at least 280° C. and will normally not exceed 550° C., the exact cutpoint being determined by the desired product properties, such as volatility, viscosity, viscosity index and pour point.

Naphthenic base oils obtained using the disclosed process have good solvency for use in applications including lubricating oils, transformer oils, chemical processing and process oils for use in rubber formulations and other products. The disclosed base oils may for example be used as a blend component to provide or replace lube products in a desired viscosity range. Exemplary base oils made using the disclosed process may have a variety of viscosity grades, for example about 52 to about 2800 Saybolt Universal Seconds (SUS) at 37.8° C. The disclosed process may be used to provide lube oils having the following desirable characteristics separately or in combination.

Naphthenic 100 SUS base oils may include the following desirable characteristics separately or in combination: an aniline point (ASTM D611) of about 64° C. to about 85° C. or about 72° C. to about 77° C.; a flash point (Cleveland Open Cup, ASTM D92) of at least about 90° C. to about 260° C., or of at least about 154° C. to about 196° C.; a viscosity (SUS at 37.8° C.) of about 85 to about 135 or about 102 to about 113; pour points (° C., ASTM D5949) of about −90° C. to about −12° C. or about −70° C. to about −30° C.; and yields that are greater than 85 vol. %, e.g., greater than about 90%, greater than about 97%, or about 97% to about 99% of total lube yield based on feedstock.

Naphthenic 500 SUS base oils may include the following desirable characteristics separately or in combination: an aniline point (ASTM D611) of about 77° C. to about 98° C. or about 82° C. to about 92° C.; a flash point (Cleveland Open Cup, ASTM D92) of at least about 111° C. to about 333° C., or of at least about 167° C. to about 278° C.; a viscosity (SUS at 37.8° C.) of about 450 to about 600 or about 500 to about 550; pour points (° C., ASTM D5949) of about −73° C. to about −17° C. or about −51° C. to about −6° C.; and yields that are greater than 85 vol. %, e.g., greater than about 90%, greater than about 97%, or about 97% to about 99%, of total lube yield based on feedstock.

Naphthenic 2000 SUS lube oils may include the following desirable characteristics separately or in combination: an aniline point (ASTM D611) of about 90° C. to about 110° C. or about 93° C. to about 103° C.; a flash point (Cleveland Open Cup, ASTM D92) of at least about 168° C. to about 363° C., or of at least about 217° C. to about 314° C.; a viscosity (SUS at 37.8° C.) of about 1700 to about 2500 or about 1900 to about 2300; pour points (° C., ASTM D5949) of about −53° C. to about 24° C. or about −33° C. to about 6° C.; and yields that are greater than 85 vol. %, e.g., greater than about 90%, greater than about 97%, or about 97% to about 99%, of total lube yield based on feedstock.

Other desirable characteristics for the disclosed base oils may include compliance with environmental standards such as EU Directive 2005/69/EC, IP346 and Modified AMES testing ASTM E1687, to evaluate whether the finished product may be carcinogenic. These tests correlate with the concentration of PAH compounds. Desirably, the disclosed base oils have less than 8 ppm, more desirably less than 2 ppm and most desirably less than 1 ppm of the sum of the 8-markers when evaluated according to European standard EN 16143:2013. The latter values represent especially noteworthy 8-markers scores, and represent up to an order of magnitude improvement beyond the EU regulatory requirement. Although as noted above industry and regulators have not yet set standards for desired amounts of 16-markers, 18-markers or 22-markers, the disclosed base oils desirably have less than 20 ppm and preferably less than 10 of the sum of the 16-markers, 18-markers or 22-markers.

The invention is further illustrated in the following non-limiting examples, in which all parts and percentages are by weight unless otherwise indicated. It should be understood however that many variations and modifications may be made while remaining within the scope of the various embodiments.

EXAMPLE 1

Five naphthenic distillate gas oil feedstocks were hydrotreated by contacting the feedstock in the presence of hydrogen with a catalyst containing nickel-molybdenum (Ni—Mo) on alumina (hydrotreating catalyst LH-23, commercially available from Criterion Catalyst Company). Table 1 below shows the feedstock characteristics before hydrotreating. The feedstocks were hydrotreated under conditions shown below in Table 2 to provide hydrotreated naphthenic effluents having the characteristics shown below in Table 3, all at liquid yields >95 wt. % of total liquid product (TLP) supplied to the hydrotreating reactor.

TABLE 1

| Feedstock Characteristics | | | | | |
|---|---|---|---|---|---|
| | Feedstock | | | | |
| Characteristic | CS100[1] | LS500[2] | LS2000[3] | PDU 372S[4] | PDU 373S[5] |
| API Gravity | 20.9 | 19.1 | 18.1 | 25.2 | 21.1 |
| Specific gravity @ 16° C. (60° F.) | 0.9285 | 0.9396 | 0.9459 | .9030 | 0.93 |
| Sulfur, wt % | 0.4550 | 0.5900 | 0.6970 | 0.4382 | 0.58 |
| Total Nitrogen, ppmw | 429 | 984 | 1855 | 4382 | 5779 |
| Acid Number | 3.1 | 3.5 | 2.7 | — | — |
| Viscosity, cst @ 40° C. (104° F.) | 35.34 | 133.8 | 553.8 | 16.54 | 128.6 |

TABLE 1-continued

| Feedstock Characteristics | | | | | |
|---|---|---|---|---|---|
| | Feedstock | | | | |
| Characteristic | CS100[1] | LS500[2] | LS2000[3] | PDU 372S[4] | PDU 373S[5] |
| SUS @ 38° C. (100° F.) | 118.8 | 718 | 3064 | 89.8 | 688 |
| Viscosity, cst @ 100° C. (212° F.) | 3.63 | 10.12 | 23.72 | 3.24 | 10.15 |
| SUS @ 99° C. (210° F.) | 38.6 | 60.8 | 118.6 | 37.2 | 60.9 |
| Calculated Viscosity Index | −18 | 25 | 31 | 29 | 34 |
| Flash Point, COC, ° C. (° F.) | 171 (340) | 227 (440) | 274 (525) | 171 (340) | 224 (435) |
| UVA 260 | 13 | 16 | 17 | 12 | 16 |
| Pour Point, ° C. (° F.) | −51 (−60) | −26 (−15) | −12 (10) | −54 (−65) | −23 (−10) |
| Aniline Point, ° C. (° F.) | 62 (144) | 76 (169) | 88 (191) | 71 (160.3) | 83 (180.6) |
| Distillation D2887 | | | | | |
| Initial BP, ° C. (° F.) | 182 (359) | 256 (492) | 374 (705) | 278 (532) | 308 (587) |
| 5%, ° C. (° F.) | 285 (546) | 376 (708) | 437 (818) | 297 (567) | 352 (665) |
| 10%, ° C. (° F.) | 306 (582) | 392 (737) | 452 (846) | 306 (583) | 373 (704) |
| 30%, ° C. (° F.) | 343 (650) | 420 (788) | 484 (903) | 331 (627) | 420 (788) |
| 50%, ° C. (° F.) | 367 (693) | 437 (819) | 506 (942) | 354 (670) | 448 (838) |
| 70%, ° C. (° F.) | 391 (735) | 456 (853) | 528 (983) | 381 (717) | 476 (889) |
| 90%, ° C. (° F.) | 424 (796) | 487 (908) | 558 (1036) | 420 (788) | 516 (960) |
| 95%, ° C. (° F.) | 441 (826) | 502 (936) | 570 (1058) | 437 (818) | 533 (991) |
| Final BP, ° C. (° F.) | 522 (972) | 557 (1034) | 586 (1086) | 479 (895) | 568 (1054) |
| Refractive Index | 1.4957 | 1.5105 | 1.5174 | 1.5001 | 1.52 |
| Clay-Gel Analysis, wt. %: | | | | | |
| Asphaltenes | <0.1 | <0.1 | <0.1 | <0.1 | <0.1 |
| Polar Compounds | 1.5 | 2.7 | 5.2 | 3.2 | 7.13 |
| Aromatics | 39.1 | 48.6 | 44.8 | 41.4 | 44.8 |
| Saturates | 59.4 | 48.7 | 50.0 | 55.4 | 48.1 |
| VGC | 0.876 | 0.888 | 0.886 | 0.866 | 0.870 |

[1]CS-100 is a non-hydrotreated light naphthenic distillate from North Sea naphthenic crude.
[2]LS-500 is a non-hydrotreated medium naphthenic distillate from North Sea naphthenic crude.
[3]LS2000 is a non-hydrotreated heavy naphthenic distillate from North Sea naphthenic crude.
[4]PDU 372S is a non-hydrotreated light naphthenic distillate from West Africa naphthenic crude.
[5]PDU 373S is a non-hydrotreated light naphthenic distillate from West Africa naphthenic crude.

TABLE 2

| Hydrotreating Conditions | |
|---|---|
| Hydrotreating Catalyst | LH-23 |
| Pressure kPa (psig) | 12,410 (1800) |
| LHSV ($hr^{-1}$) | 0.55 |
| WABT, ° C. (° F.) | 316-343 (600-650) |

TABLE 3

| Hydrotreated Effluent Characteristics | | | | | |
|---|---|---|---|---|---|
| Characteristic | C100 | L500 | L2000 | PDU372L | PDU373L |
| API Gravity | 24.8 | 23.2 | 22.2 | 27.6 | 22.7 |
| Sp. gr. @ 15.6/15.6° C. (60/60° F.) | 0.9051 | 0.9146 | 0.9208 | 0.8892 | 0.9179 |
| Sulfur, wt % | 0.021 | 0.061 | 0.0995 | 0.0399 | 0.1323 |
| Sulfur, ppm | 210 | 610 | 995 | 399 | 1323 |
| Aniline Pt., ° C. (° F.) | 76.6 (169.9) | 87.1 (188.8) | 98.6 (209.4) | 79.0 (174.2) | 89.6 (193.3) |
| Flash point, COC, ° C. (° F.) | 168 (335) | 227 (440) | 285 (545) | 177 (350) | 216 (420) |
| UV @ 260 nm | 0.48 | 3.34 | 7.06 | 1.61 | 5.43 |
| RI @ 20° C. (68° F.) | 1.4946 | 1.5021 | 1.5087 | 1.4885 | 1.5039 |
| cSt @40° C. (104° F.) | 20.8 | 100.3 | 391.7 | 16.39 | 120.9 |
| cSt @ 100° C. (212° F.) | 3.6 | 8.8 | 20.9 | 3.24 | 9.97 |
| SUS @ 38° C. (100° F.) | 110.1 | 533 | 2137 | 89.1 | 645 |
| SUS @ 99° C. (210° F.) | 38.5 | 56.1 | 105.8 | 37.2 | 60.2 |
| Viscosity Index | 11 | 38 | 50 | 32 | 40 |
| Color ASTM | 0.2 | 0.9 | 2.5 | 0.2 | 1.3 |
| Pour Point, ° C. (° F.) | −51 (−60) | −29 (−20) | −14 (7) | −54 (−65) | −23 (−10) |
| VGC | 0.866 | 0.856 | 0.844 | — | — |
| Nitrogen (total) ppmw | 1 | 207 | 870 | — | — |

TABLE 3-continued

| Hydrotreated Effluent Characteristics | | | | | |
|---|---|---|---|---|---|
| Characteristic | C100 | L500 | L2000 | PDU372L | PDU373L |
| Clay-Gel Analysis, wt. %: | | | | | |
| Asphaltenes | | | | | |
| Polar Compounds | 63.0 | 54.4 | 52.1 | 60.6 | 51.9 |
| Aromatics | 0.7 | 1.5 | 5.5 | 1.2 | 3.1 |
| Saturates | 36.3 | 44.1 | 42.4 | 38.2 | 44.9 |
| Carbon type: | | | | | |
| % $C_A$ | 10 | 12 | 15 | 11 | 13 |
| % $C_N$ | 47 | 37 | 27 | 38 | 37 |
| % $C_P$ | 43 | 51 | 58 | 51 | 50 |
| Distillation D2887: | | | | | |
| Initial BP, ° C. (° F.) | 246 (475) | 321 (609) | 366 (690) | 276 (528) | 323 (613) |
| 5%, ° C. (° F.) | 279 (535) | 359 (678) | 407 (764) | 296 (565) | 354 (670) |
| 10%, ° C. (° F.) | 295 (563) | 373 (704) | 425 (797) | 304 (580) | 371 (700) |
| 20%, ° C. (° F.) | | | | 317 (603) | 395 (743) |
| 30%, ° C. (° F.) | 329 (624) | 403 (758) | 465 (869) | 328 (623) | 413 (775) |
| 40%, ° C. (° F.) | | | | 340 (644) | 427 (801) |
| 50%, ° C. (° F.) | 353 (667) | 424 (795) | 494 (921) | 352 (665) | 439 (823) |
| 60%, ° C. (° F.) | | | | 364 (687) | 452 (846) |
| 70%, ° C. (° F.) | 377 (710) | 446 (834) | 522 (971) | 378 (712) | 468 (874) |
| 80%, ° C. (° F.) | | | | 394 (742) | 484 (904) |
| 90%, ° C. (° F.) | 413 (776) | 479 (895) | 555 (1,031) | 417 (783) | 506 (943) |
| 95%, ° C. (° F.) | 429 (804) | 496 (924) | 569 (1,057) | 434 (813) | 523 (974) |
| End Point, ° C. (° F.) | 469 (876) | 532 (990) | 593 (1,100) | 477 (891) | 558 (1,037) |
| Other | | | | | |
| PAH 8-Markers, ppm | | 3.2 | 4.7 | — | — |
| IP346, wt. % | 2.8 | 2.3 | 2.4 | — | — |
| FLOC Point, ° C. (° F.) | | −19 (−2) | | — | — |
| NMR Wax, mass % | 0.35 | 0.83 | 1.96 | 1.11 | 1.92 |

The results in Table 3 show that desirable pour points were achieved at high yields and reduced temperatures, using a high nitrogen content feedstock.

EXAMPLE 2

The L500 hydrotreated feedstock prepared in Example 1 was catalytically dewaxed and hydrofinished in the presence of a zeolite-based bifunctional catalyst (HYDEX-L™, commercially available from Clariant) under various conditions shown below in Table 4 and fractionated to make four 500 SUS (at 100° F.) naphthenic base oil products identified as L500DW (A) through L500DW(D) and having the properties shown below in Table 5.

TABLE 4

| Dewaxing (HDW) and Hydrofinishing (HDF) Conditions | | | | |
|---|---|---|---|---|
| | L500 (A) | L500 (B) | L500 (C) | L500 (D) |
| Pressure kPa (psig) | 11,376 (1650) | 11,376 (1650) | 11,376 (1650) | 11,376 (1650) |
| Temp RX1 (HDW), ° C. (° F.) | 302 (575) | 302 (575) | 302 (575) | 329 (625) |
| Temp RX2 (HDF), ° C. (° F.) | 302 (575) | 329 (625) | 343 (650) | 343 (650) |
| LHSV ($hr^{-1}$) | 1.5 | 1.5 | 1.5 | 1.5 |

TABLE 5

| Naphthenic Base Oil Characteristics | | | | |
|---|---|---|---|---|
| Characteristic | L500DW (A) | L500DW (B) | L500DW (C) | L500DW (D) |
| API Gravity | 23.2 | 23.4 | 23.6 | 23.6 |
| Sp. gr. @ 15.6/15.6° C. (60/60° F.) | 0.9146 | 0.9135 | 0.9123 | 0.9124 |
| Sulfur, wt. % | 0.0400 | 0.0270 | 0.0169 | 0.0182 |
| Sulfur, ppm | 400 | 270 | 169 | 182 |
| Aniline Pt., ° C. (° F.) | 88.4 (191.2) | 89.4 (193.0) | 90.3 (194.6) | 90.3 (194.5) |
| Flash point, COC, ° C. (° F.) | 243 (470) | 227 (440) | 227 (440) | 232 (450) |

TABLE 5-continued

| Naphthenic Base Oil Characteristics | | | | |
|---|---|---|---|---|
| Characteristic | L500DW (A) | L500DW (B) | L500DW (C) | L500DW (D) |
| UV @ 260 nm | 2.51 | 2.16 | 2.20 | 2.92 |
| RI @ 20° C. (68° F.) | 1.5012 | 1.5001 | 1.4996 | 1.4996 |
| cSt @ 40° C. (104° F.) | 105 | 101 | 99 | 100 |
| cSt @ 100° C. (212° F.) | 9.0 | 8.9 | 8.7 | 8.7 |
| SUS @ 38° C. (100° F.) | 560 | 539 | 525 | 529 |
| SUS @ 60° C. (140° F.) | 187 | 180 | 173 | 164 |
| SUS @ 99° C. (210° F.) | 56.6 | 56.2 | 55.5 | 55.6 |
| Viscosity Index | 33 | 37 | 34 | 34 |
| Color ASTM | 1.6 | 1.0 | 0.8 | 0.8 |
| Pour Point, ° C. (° F.) | −29 (−20) | −29 (−20) | −28 (−18) | −26 (−15) |
| Cloud Point, ° C. (° F.) | 26 (78) | | | 5 (41) |
| VGC | 0.854 | 0.854 | 0.852 | 0.852 |
| Nitrogen (total) ppmw | 56 | 40 | 31 | 29 |
| Clay-Gel Analysis, wt. %: | | | | |
| Asphaltenes | <.1 | | <.1 | <.1 |
| Polar Compounds | 61.2 | 61.0 | 56.5 | 55.7 |
| Aromatics | 1.1 | 0.9 | 0.7 | 1.2 |
| Saturates | 37.7 | 38.1 | 42.8 | 43.1 |
| Carbon type: | | | | |
| % $C_A$ | 11 | 10 | 10 | 10 |
| % $C_N$ | 39 | 40 | 39 | 39 |
| % $C_P$ | 50 | 50 | 51 | 51 |
| Distillation D2887: | | | | |
| Initial BP, ° C. (° F.) | 337 (639) | 329 (625) | 322 (612) | 320 (608) |
| 5%, ° C. (° F.) | 370 (698) | 367 (693) | 365 (689) | 364 (688) |
| 10%, ° C. (° F.) | 383 (722) | 382 (719) | 379 (715) | 379 (714) |
| 20%, ° C. (° F.) | 401 (753) | 399 (751) | 397 (747) | 397 (747) |
| 30%, ° C. (° F.) | 413 (775) | 412 (774) | 410 (770) | 410 (770) |
| 40%, ° C. (° F.) | 424 (795) | 423 (793) | 421 (789) | 421 (789) |
| 50%, ° C. (° F.) | 433 (812) | 433 (812) | 431 (807) | 430 (806) |
| 60%, ° C. (° F.) | 443 (830) | 443 (830) | 441 (825) | 440 (824) |
| 70%, ° C. (° F.) | 454 (850) | 454 (850) | 452 (845) | 451 (844) |
| 80%, ° C. (° F.) | 468 (875) | 468 (875) | 464 (868) | 464 (867) |
| 90%, ° C. (° F.) | 488 (911) | 488 (911) | 484 (904) | 484 (904) |
| 95%, ° C. (° F.) | 504 (940) | 505 (941) | 502 (935) | 501 (933) |
| End Point, ° C. (° F.) | 541 (1,006) | 546 (1,015) | 552 (1,026) | 545 (1,013) |
| Other | | | | |
| PAH 8-Markers, ppm | 1.7 | | 1.5 | 1.5 |
| IP346, wt. % | 1.7 | 1.6 | 0.4 | 2.8 |
| FLOC Point, ° C. (° F.) | −27 (−17) | −26 (−15) | −24 (−11) | −26 (−15) |
| NMR Wax, mass % | 0.26 | 0.85 | 0.15 | 0.72 |
| Mass Balance Data: | | | | |
| Lube Yield on TLP, % | 99.87 | 99.77 | 99.59 | 99.57 |

The results show that desirable cloud points, pour points and FLOC points were achieved without affecting the yield and at considerably reduced temperatures. The yields for all the above products were over 99 wt. % of total liquid product.

EXAMPLE 3

The L2000 hydrotreated feedstock prepared in Example 1 was catalytically dewaxed and hydrofinished in the presence of a zeolite-based catalyst (HYDEX-L™, commercially available from Clariant) under various conditions shown below in Table 6and fractionated to make four 2000 SUS naphthenic base oil products identified as L2000DW (A) through L200DW (D) and having the properties shown in below Table 7.

TABLE 6

Dewaxing (HMV) and Hydrofinishing (HDF) Conditions

| | L2000 (A) | L2000 (B) | L2000 (C) | L2000 (D) |
|---|---|---|---|---|
| Pressure kPa (psig) | 11,376 (1650) | 11,376 (1650) | 11,376 (1650) | 11,376 (1650) |
| Temp RX1 (HDW), ° C. (° F.) | 330 (625) | 302 (575) | 302 (575) | 302 (575) |
| Temp RX2 (HDF), ° C. (° F.) | 343 (650) | 343 (650) | 330 (625) | 302 (575) |
| LHSV ($hr^{-1}$) | 1.5 | 1.5 | 1.5 | 1.5 |

TABLE 7

Naphthenic Base Oil Characteristics

| Characteristic | L2000DW (A) | L2000DW (B) | L2000DW (C) | L2000DW (D) |
|---|---|---|---|---|
| API Gravity | 22.6 | 22.3 | 22.1 | 22.0 |
| Sp. gr. @ 15.6/15.6° C. (60/60° F.) | 0.9184 | 0.9202 | 0.9211 | 0.9221 |
| Sulfur, wt. % | 0.0483 | 0.0515 | 0.0652 | 0.0774 |
| Sulfur, ppm | 483 | 515 | 652 | 774 |
| Aniline Pt., ° C. (° F.) | 100.1 (212.1) | 100.1 (212.2) | 99.8 (211.7) | 98.8 (209.8) |
| Flash point, COC, ° C. (° F.) | 268 (515) | 271 (520) | 277 (530) | 274 (525) |
| UV @ 260 nm | 4.34 | 6.01 | 5.80 | 6.35 |
| RI @ 20° C. (68° F.) | 1.5058 | 1.5061 | 1.5067 | 1.5076 |
| cSt @ 40° C. (104° F.) | 376 | 371 | 382 | 390 |
| cSt @ 100° C. (212° F.) | 20.1 | 20.0 | 20.3 | 20.5 |
| SUS @ 38° C. (100° F.) | 2053 | 2025 | 2086 | 2131 |
| SUS @ 60° C. (140° F.) | 498 | 494 | 504 | 521 |
| SUS @ 99° C. (210° F.) | 102.0 | 101.7 | 102.7 | 104.0 |
| Viscosity Index | 46 | 47 | 45 | 46 |
| Color ASTM | 2.3 | 2.0 | 2.4 | 2.1 |
| Pour Point, ° C. (° F.) | −12 (10) | −13 (9) | −12 (10) | −12 (10) |
| Cloud Point, ° C. (° F.) | 33 (92) | 35 (95) | 33 (92) | 34 (94) |
| VGC | 0.841 | 0.844 | 0.845 | 0.846 |
| Nitrogen (total) ppmw | 167 | 176 | 220 | 252 |
| Clay Gel Analysis, wt. %: | | | | |
| Asphaltenes | <.1 | <.1 | <.1 | <.1 |
| Polar Compounds | 47.8 | 52.4 | 48.3 | 42.0 |
| Aromatics | 3.7 | 2.7 | 3.5 | 4.1 |
| Saturates | 48.6 | 44.9 | 48.2 | 53.9 |
| Carbon type: | | | | |
| % $C_A$ | 12 | 12 | 12 | 13 |
| % $C_N$ | 30 | 32 | 32 | 31 |
| % $C_P$ | 58 | 56 | 56 | 56 |
| Distillation D2887: | | | | |
| Initial BP, ° C. (° F.) | 354 (670) | 355 (671) | 364 (688) | 239 (462) |
| 5%, ° C. (° F.) | 409 (769) | 411 (772) | 415 (779) | 406 (763) |
| 10%, ° C. (° F.) | 428 (803) | 429 (805) | 433 (811) | 428 (803) |
| 20%, ° C. (° F.) | 451 (844) | 452 (846) | 456 (852) | 453 (847) |
| 30%, ° C. (° F.) | 469 (876) | 471 (879) | 472 (882) | 472 (881) |
| 40%, ° C. (° F.) | 485 (905) | 486 (906) | 487 (909) | 486 (907) |

TABLE 7-continued

| Naphthenic Base Oil Characteristics | | | | |
|---|---|---|---|---|
| Characteristic | L2000DW (A) | L2000DW (B) | L2000DW (C) | L2000DW (D) |
| 50%, ° C. (° F.) | 499 (930) | 499 (931) | 502 (935) | 500 (932) |
| 60%, ° C. (° F.) | 512 (954) | 513 (955) | 515 (959) | 515 (959) |
| 70%, ° C. (° F.) | 528 (982) | 527 (981) | 530 (986) | 529 (984) |
| 80%, ° C. (° F.) | 543 (1010) | 543 (1010) | 546 (1015) | 545 (1013) |
| 90%, ° C. (° F.) | 565 (1049) | 564 (1047) | 567 (1052) | 564 (1048) |
| 95%, ° C. (° F.) | 577 (1071) | 577 (1070) | 578 (1073) | 577 (1070) |
| End Point, ° C. (° F.) | 628 (1162) | 600 (1112) | 583 (1081) | 603 (1118) |
| Other | | | | |
| PAH 8-Markers, ppm | 1.2 | 1.2 | 0.6 | 0.7 |
| IP346, wt. % | 1.0 | 0.5 | 1.4 | 0.7 |
| NMR Wax, mass % | 0.88 | 0.9 | 1.67 | 1.22 |
| Mass Balance Data: | | | | |
| Lube Yield on TLP, % | 99.64 | 99.69 | 99.78 | 99.88 |

The results show that desirable cloud points and pour points were achieved without affecting the yield, at considerably reduced temperatures, and while using a high nitrogen content feedstock. The yields for all the above products were over 99 wt. % of total liquid product.

EXAMPLE 4

The wax-containing hydrotreated light naphthenic distillate (PDU372L) feedstock described in Example 1 was catalytically dewaxed and hydrofinished in the presence of a zeolite-based catalyst (HYDEX-L™, commercially available from Clariant) under various conditions shown below in Table 8 and fractionated to make four light naphthenic base oil products identified as PDU372DW (A) through PDU372DW (D) and having the properties shown below in Table 9.

TABLE 8

| Dewaxing (HDW) and Hydrofinishing (HDF) Conditions | | | | |
|---|---|---|---|---|
| | PDU372L (A) | PDU372L (B) | PDU372L (C) | PDU372L (D) |
| Pressure kPa (psig) | 11,376 (1650) | 11,376 (1650) | 11,376 (1650) | 11,376 (1650) |
| Temp RX1 (HDW), ° C. (° F.) | 302 (575) | 316 (600) | 329 (625) | 329 (625) |
| Temp RX2 (HDF), ° C. (° F.) | 302 (575) | 302 (575) | 302 (575) | 329 (625) |
| LHSV ($hr^{-1}$) | 1.5 | 1.5 | 1.5 | 1.5 |

TABLE 9

| Naphthenic Base Oil Characteristics | | | | |
|---|---|---|---|---|
| Characteristic | PDU372DW (A) | PDU372DW (B) | PDU372DW (C) | PDU372DW (D) |
| API Gravity | 27.5 | 27.3 | 27.1 | 27.4 |
| Sp. gr. @ 15.6/15.6° C. (60/60° F.) | 0.8899 | 0.8910 | 0.8919 | 0.8907 |
| Sulfur, wt. % | 0.0230 | 0.0220 | 0.0210 | 0.0110 |
| Sulfur, ppm | 230 | 220 | 210 | 110 |
| Aniline Pt., ° C. (° F.) | 78.7 (173.7) | 78.4 (173.1) | 79.1 (174.3) | 81.2 (178.1) |
| Flash point, COC, ° C. (° F.) | 355 | 375 | 365 | 360 |
| UV @ 260 nm | 1.54 | 1.37 | 1.19 | 1.15 |
| RI @ 20° C. (68° F.) | 1.4886 | 1.4886 | 1.4895 | 1.4879 |
| cSt @ 40° C. (104° F.) | 17 | 18 | 17 | 17 |
| cSt @ 100° C. (212° F.) | 3.4 | 3.5 | 3.3 | 3.5 |
| SUS @ 38° C. (100° F.) | 92 | 94 | 94 | 93 |
| SUS @ 60° C. (140° F.) | 54.6 | 55.1 | 55.4 | 55.1 |
| SUS @ 99° C. (210° F.) | 37.9 | 38.0 | 37.5 | 38.1 |
| Viscosity Index | 60 | 54 | 26 | 63 |
| Color ASTM | 0.5 | 0.5 | 0.4 | 0.5 |
| Pour Point, ° C. (° F.) | −59 (−74) | −58 (−72) | −58 (−72) | −56 (−69) |
| Cloud Point, ° C. (° F.) | −74 (−101) | −75 (−103) | −75 (−103) | −75 (−103) |
| VGC | 0.851 | 0.852 | 0.853 | 0.852 |
| Nitrogen (total) ppmw | 44 | 48 | 43 | 45 |

TABLE 9-continued

| Naphthenic Base Oil Characteristics | | | | |
|---|---|---|---|---|
| Characteristic | PDU372DW (A) | PDU372DW (B) | PDU372DW (C) | PDU372DW (D) |
| Clay Gel Analysis, wt. %: | | | | |
| Asphaltenes | | | | |
| Polar Compounds | 67.9 | 68.3 | 70.3 | 69.1 |
| Aromatics | 1.1 | 1.0 | 1.2 | 1.0 |
| Saturates | 31 | 30.7 | 28.5 | 29.9 |
| Carbon type: | | | | |
| % $C_A$ | 10 | 10 | 9 | 9 |
| % $C_N$ | 39 | 40 | 41 | 41 |
| % $C_P$ | 51 | 50 | 50 | 50 |
| Distillation D2887: | | | | |
| Initial BP, ° C. (° F.) | 282 (539) | 282 (539) | 278 (533) | 273 (524) |
| 5%, ° C. (° F.) | 302 (576) | 302 (576) | 302 (575) | 301 (574) |
| 10%, ° C. (° F.) | 311 (591) | 311 (591) | 311 (591) | 310 (590) |
| 20%, ° C. (° F.) | 323 (614) | 323 (614) | 323 (614) | 323 (613) |
| 30%, ° C. (° F.) | 334 (634) | 335 (635) | 335 (635) | 335 (635) |
| 40%, ° C. (° F.) | 346 (655) | 347 (656) | 346 (655) | 347 (656) |
| 50%, ° C. (° F.) | 358 (676) | 358 (676) | 358 (676) | 358 (677) |
| 60%, ° C. (° F.) | 371 (699) | 370 (698) | 370 (698) | 371 (700) |
| 70%, ° C. (° F.) | 383 (722) | 383 (722) | 384 (723) | 384 (724) |
| 80%, ° C. (° F.) | 401 (753) | 401 (753) | 401 (753) | 402 (755) |
| 90%, ° C. (° F.) | 423 (793) | 423 (793) | 423 (794) | 424 (795) |
| 95%, ° C. (° F.) | 440 (824) | 439 (823) | 439 (823) | 441 (825) |
| End Point, ° C. (° F.) | 484 (903) | 481 (897) | 480 (896) | 483 (902) |
| Other | | | | |
| NMR Wax, mass % | 0 | 0 | 0.26 | 0 |
| Mass Balance Data: | | | | |
| Lube Yield on TLP | 99.74% | 99.76% | 99.73% | 99.59% |

The results show that desirable cloud points and pour points were achieved without affecting the yield, at considerably reduced temperatures, and while using a high nitrogen content feedstock. The yields for all the above products were over 99 wt. % of total liquid product.

EXAMPLE 5

The hydrotreated wax-containing heavy naphthenic distillate feedstock (PDU 373L) described in Example 1 was catalytically dewaxed and hydrofinished in the presence of a zeolite-based catalyst (HYDEX-L™, commercially available from Clariant) under various conditions shown below in Table 10 and fractionated to provide three dewaxed, heavy hydrotreated naphthenic distillate products identified as PDU373DW (A) through PDU373DW (C) and having the properties shown below in Table 11.

TABLE 10

| Dewaxing (HDVV) and Hydrofinishing (HDF) Conditions | | | |
|---|---|---|---|
| Condition | PDU373L (A) | PDU373L (B) | PDU373L (C) |
| Pressure kPa (psig) | 11,376 (1650) | 11,376 (1650) | 11,376 (1650) |
| Temp RX1 (HDW), ° C. (° F.) | 329 (625) | 329 (625) | 316 (600) |
| Temp RX2 (HDF), ° C. (° F.) | 329 (625) | 302 (575) | 302 (575) |
| LHSV ($hr^{-1}$) | 1.5 | 1.5 | 1.5 |

TABLE 11

| Naphthenic Distillate Characteristics | | | |
|---|---|---|---|
| Characteristic | PDU373DW (A) | PDU373DW (B) | PDU373DW (C) |
| API Gravity | 23.0 | 22.8 | 22.9 |
| Sp. gr. @ 15.6/15.6° C. (60/60° F.) | 0.9160 | 0.9172 | 0.9167 |
| Sulfur, wt. % | 0.0730 | 0.1010 | 0.1020 |
| Sulfur, ppm | 730 | 1010 | 1020 |
| Aniline Pt., ° C. (° F.) | 81.1 (177.9) | 89.2 (192.5) | 89.4 (192.9) |
| Flashpoint, COC, ° C. (° F.) | 216 (420) | 224 (435) | 218 (425) |
| UV @ 260 nm | 3.83 | 4.73 | 4.57 |
| RI @ 20° C. (68° F.) | 1.5030 | 1.5039 | 1.5037 |
| cSt @ 40° C. (104° F.) | 127 | 129 | 130 |
| cSt @ 100° C. (212° F.) | 10.2 | 10.3 | 10.3 |
| SUS @ 38° C. (100° F.) | 679 | 692 | 692 |
| SUS @ 99° C. (210° F.) | 61.2 | 61.3 | 61.4 |
| Viscosity Index | 39 | 36 | 38 |
| Color ASTM | 1.9 | 1.4 | 1.5 |
| Pour Point, ° C. (° F.) | −32 (−25) | −31 (−24) | −30 (−22) |
| Cloud Point, ° C. (° F.) | nd | nd | nd |
| VGC | 0.854 | 0.855 | 0.855 |
| Nitrogen (total) ppmw | 307 | 652 | 694 |

TABLE 11-continued

| Naphthenic Distillate Characteristics | | | |
|---|---|---|---|
| Characteristic | PDU373DW (A) | PDU373DW (B) | PDU373DW (C) |
| Clay Gel Analysis, wt. %: | | | |
| Asphaltenes | <.1 | <.1 | <.1 |
| Polar Compounds | 57.8 | 56.0 | 57.6 |
| Aromatics | 2.3 | 2.2 | 2.3 |
| Saturates | 39.5 | 41.7 | 40.1 |
| Carbon type: | | | |
| % $C_A$ | 12 | 12 | 13 |
| % $C_N$ | 36 | 36 | 36 |
| % $C_P$ | 52 | 52 | 51 |
| NMR Wax, mass % | 0.29 | 0.62 | 0.92 |
| Mass Balance Data: | | | |
| Lube Yield on TLP | 99.22% | 99.73% | 99.78% |

The results show that desirable cloud points (and in the case of distillate L373(D), a desirable pour point) were achieved without affecting the yield, at considerably reduced temperatures, and while using a high nitrogen content feedstock. The yields for all the above products were over 99 wt. % of total liquid product.

EXAMPLE 5

22-Marker, 18-Marker, 16-Marker and 8-Marker Testing

L500 and L2000 naphthenic base oils like those made in Examples 2 and 3 were evaluated for PAH levels to determine 22-markers, 18 markers, 16-markers and 8-markers levels in ppm. The results are shown below in Table 12.

TABLE 12

| PAH Levels | | | | | |
|---|---|---|---|---|---|
| 22-Marker PAH | 18-Marker PAH? | 16-Marker PAH? | 8-Marker PAH? | L500 Level, ppm | L2000 Level, ppm |
| Acenaphthene | Yes | Yes | | 0.047 | 0.042 |
| Acenaphthylene | Yes | Yes | | 0.003 | 0.001 |
| Anthracene | Yes | Yes | | 0.054 | 0.012 |
| Benzo(a)anthracene | Yes | Yes | Yes | 0.029 | 0.016 |
| Benzo(a)pyrene | Yes | Yes | Yes | 0.009 | 0.034 |
| Benzo(b)fluoranthene | Yes | Yes | Yes | 0.012 | 0.035 |
| Benzo(e)pyrene | Yes | | Yes | 0.353 | 0.748 |
| Benzo(ghi)perylene | Yes | Yes | | 0.946 | 4.57 |
| Benzo(j)fluoranthene | Yes | | Yes | 0.007 | 0.014 |
| Benzo(k)fluoranthene | Yes | Yes | Yes | 0.007 | 0.019 |
| Chrysene | Yes | Yes | Yes | 0.008 | 0.009 |
| Dibenzo(a,e)pyrene | | | | 0.012 | 0.039 |
| Dibenzo(a,h)anthracene | Yes | Yes | Yes | Not Detected | Not Detected |
| Dibenzo(a,h)pyrene | | | | Not Detected | Not Detected |
| Dibenzo(a,i)pyrene | | | | 0.021 | 0.14 |
| Dibenzo(a,l)pyrene | | | | 0.008 | 0.011 |
| Fluoranthene | Yes | Yes | | 0.057 | 0.024 |
| Fluorene | Yes | Yes | | 0.259 | 0.103 |
| Indeno[123-cd]pyrene | Yes | Yes | | 0.013 | 0.047 |
| Naphthalene | Yes | Yes | | 0.167 | 0.002 |
| Phenanthrene | Yes | Yes | | 0.12 | 0.081 |
| Pyrene | Yes | Yes | | 0.234 | 0.298 |
| Total 22-Markers, ppm | | | | 2.37 | 6.25 |
| Total 18-Markers, ppm | | | | 2.33 | 6.06 |
| Total 16-Markers, ppm | | | | 1.97 | 5.29 |
| Total 8-Markers, ppm | | | | 0.43 | 0.88 |

We claim:

1. A process for producing a naphthenic base oil comprising the steps of:

a) hydrotreating a naphthenic feedstock having a sulfur content of up to about 5% by weight (as measured by ASTM D4294) and a nitrogen content of up to about 3% by weight (as measured by ASTM D5762) and comprising more than 50 wt. % naphthenic vacuum distillate fractions in the presence of a hydrotreating catalyst and hydrotreating conditions to produce a hydrotreated naphthenic effluent;

b) dewaxing the hydrotreated naphthenic effluent having a sulfur content of about 0.0005% to about 0.5% by weight (as measured by ASTM D4294) and a nitrogen content of up to about 0.1% by weight (as measured by ASTM D5762) in the presence of a dewaxing cracking catalyst and under catalytic dewaxing conditions to produce a dewaxed effluent;

c) hydrofinishing the dewaxed effluent in the presence of a hydrofinishing catalyst and under catalytic hydrofinishing conditions to produce a dewaxed hydrofinished effluent having reduced levels of polycyclic aromatic hydrocarbon compounds and reduced levels of unstable olefinic compounds; and d) fractionating the dewaxed hydrofinished effluent to remove one or more low viscosity high volatility fractions and provide a naphthenic base oil having a pour point (as measured by ASTM D5949) below about −5° C., at a yield greater than 85% of total naphthenic base oil over total hydrotreated naphthenic feedstock.

2. The process of claim 1, wherein the naphthenic feedstock comprises naphthenic crude, waxy naphthenic crude, naphthenic distillate or a mixture thereof.

3. The process of claim 1, wherein the naphthenic feedstock comprises a blend of naphthenic crude, waxy naphthenic crude or a naphthenic distillate with paraffinic feedstock, paraffinic distillate, light or heavy cycle oil, deasphalted oil, cracker residue, hydrocarbon feedstock containing heteroatom species and aromatics and boiling at about 150° C. to about 550° C. (as measured by ASTM D7169), or mixture thereof.

4. The process of claim 3, wherein the naphthenic feedstock comprises up to 50 wt. % deasphalted oils containing sulfur- and nitrogen-containing compounds.

5. The process of claim 1, wherein the naphthenic feedstock contains about 0.5 wt. % to 15 wt. % waxy compounds based on total feedstock.

6. The process of claim 1, wherein the hydrotreating conditions include a temperature of about 260° C. to about 399° C., a pressure of about 5,515 kPa to about 27,579 kPa and a liquid hourly space velocity of about 0.25 to about 5 cc of oil per cc of catalyst per hour ($hr^{-1}$).

7. The process of claim 1, wherein the hydrotreated naphthenic effluent contains about 0.01 to about 0.15 wt. % sulfur.

8. The process of claim 1, wherein the hydrotreated naphthenic effluent contains about 0.01 to about 0.1 wt. % nitrogen.

9. The process of claim 1, wherein the dewaxing catalyst is a molecular sieve zeolite having a 10-membered oxygen ring, a mordenite framework inverted zeolite or a ZSM-5 catalyst.

10. The process of claim 1, wherein the dewaxing catalyst is a bifunctional catalyst having both a dewaxing function and a hydrogenation function.

11. The process of claim 1, wherein the dewaxing conditions comprise a temperature from about 260° C. to about 399° C., a pressure from about 5,515 kPa to about 27,579 kPa, and a liquid hourly space velocity from about 0.25 $hr^{-1}$ to about 7 $hr^{-1}$.

12. The process of claim 1, wherein the hydrofinishing conditions comprise a temperature from about 260° C. to about 399° C., a pressure from to about 5,515 kPa to about 27,579 kPa, and a liquid hourly space velocity from about 0.25 to about 5 $hr^{-1}$.

13. The process of claim 1, wherein the naphthenic base oil has a viscosity of about 52 to about 2800 Saybolt Universal Seconds at 37.8° C.

14. The process of claim 1, wherein the pour point is below about −10° C.

15. The process of claim 1, wherein the yield is greater than about 97% of total naphthenic base oil over total hydrotreated naphthenic effluent.

16. The process of claim 1, wherein the naphthenic base oil contains no more than 10 ppm total polycyclic aromatic hydrocarbon 8-markers and no more than 1 ppm benzo[a] pyrene as evaluated using European standard EN 16143: 2013.

17. The process of claim 1, wherein the naphthenic base oil is a 100 SUS base oil having an aniline point (ASTM D611) of about 64° C. to about 85° C., a flash point (Cleveland Open Cup, ASTM D92) of at least about 90° C. to about 260° C., a viscosity (SUS at 37.8° C.) of about 85 to about 135, and a pour point (° C., ASTM D5949) of about −90° C. to about −12° C.

18. The process of claim 1, wherein the naphthenic base oil is a 500 SUS base oil having an aniline point (ASTM D611) of about 77° C. to about 98° C., a flash point (Cleveland Open Cup, ASTM D92) of at least about 111° C. to about 333° C., a viscosity (SUS at 37.8° C.) of about 450 to about 600, and a pour point (° C., ASTM D5949) of about −73° C. to about −17° C.

19. The process of claim 1, wherein the naphthenic base oil is a 2000 SUS base oil having an aniline point (ASTM D611) of about 90° C. to about 110° C., a flash point (Cleveland Open Cup, ASTM D92) of at least about 168° C. to about 363° C., a viscosity (SUS at 37.8° C.) of about 1700 to about 2500, and a pour point (° C., ASTM D5949) of about −53° C. to about 24° C.

20. The process of claim 1, wherein the naphthenic base oil contains no more than 20 ppm total of the polycyclic aromatic hydrocarbon compounds acenaphthene, acenaphthylene, anthracene, benzo(a)anthracene, benzo(a)pyrene, benzo(b)fluoranthene, benzo(e)pyrene, benzo(ghi)perylene, benzo(j)fluoranthene, benzo(k)fluoranthene, chrysene, dibenzo(a,e)pyrene, dibenzo(a,h)anthracene, dibenzo(a,h) pyrene, dibenzo(a,i)pyrene, dibenzo(a,l)pyrene, fluoranthene, fluorene, indeno[123-cd]pyrene, naphthalene, phenanthrene and pyrene.

* * * * *